US005410295A

United States Patent [19]

Van Lint

[11] Patent Number: 5,410,295

[45] Date of Patent: Apr. 25, 1995

[54] ANTI-THEFT SYSTEM FOR CURRENCY STORED IN A VAULT

[75] Inventor: Greg Van Lint, Wilmington, Del.

[73] Assignee: ICI Americas Inc., Wilmington, Del.

[21] Appl. No.: 918,572

[22] Filed: Jul. 22, 1992

[51] Int. Cl.[6] ..... G08B 13/14

[52] U.S. Cl. ..... 340/568; 340/309.15; 340/522; 340/571

[58] Field of Search ..... 340/568, 571, 550, 541, 340/521, 522, 527, 679, 309.15, 825.31, 825.32, 825.35, 691, 329; 109/25, 29–34, 38–44; 241/33, 36; 235/382; 902/9, 13; 232/43.3, 1 D

[56] References Cited

U.S. PATENT DOCUMENTS

| | | | |
|---|---|---|---|
| 2,041,577 | 5/1936 | Sutherland | 340/571 X |
| 3,564,525 | 2/1971 | Robeson et al. | 340/571 X |
| 3,633,194 | 1/1972 | Kothe | 340/550 |
| 3,685,037 | 8/1972 | Bennett et al. | 340/571 |
| 3,828,341 | 8/1974 | Carter, Jr. et al. | 340/571 |
| 4,267,553 | 5/1981 | Vogelsanger et al. | 340/571 |
| 4,327,360 | 4/1982 | Brown | 340/571 |
| 4,686,514 | 8/1987 | Liptak, Jr. et al. | 340/571 |
| 4,908,606 | 3/1990 | Kevonian | 340/571 |
| 4,908,608 | 3/1990 | Reinke et al. | 340/571 |
| 4,975,680 | 12/1990 | Fogle, Jr. | 340/571 |
| 4,985,695 | 1/1991 | Wilkinson et al. | 340/571 |
| 5,091,713 | 2/1992 | Horne et al. | 340/541 |
| 5,130,695 | 7/1992 | Scarbrough et al. | 340/568 X |

FOREIGN PATENT DOCUMENTS

| | | | |
|---|---|---|---|
| 2435 | 2/1993 | WIPO | 340/571 |

*Primary Examiner*—John K. Peng
*Assistant Examiner*—Thomas J. Mullen, Jr.
*Attorney, Agent, or Firm*—Howson & Howson

[57] ABSTRACT

An anti-theft system for an automatic teller machine (ATM) causes a currency alarm pack to deface the currency supply in the event that an attempt is made to transport the entire ATM. When the machine is moved, a localized field is momentarily activated and thereafter deactivated and disabled for a first predetermined interval. A triggerable currency alarm in the money supply of the machine, includes a field detector and a motion detector. The currency alarm is triggered when the following three conditions concur. First, the field detector detects the localized field and thereafter ceases to detect the localized field. Second, the motion detector detects motion of the currency alarm during a predetermined delay interval less than the first predetermined interval during which the field is disabled. Third, the field detector does not reacquire the localized field during the predetermined delay interval. Thus the currency alarm operates not only when an attempt is made to remove the currency supply from the machine, but also when an attempt is made to move the machine itself.

12 Claims, 5 Drawing Sheets

ANTI-THEFT SYSTEM FOR CURRENCY STORED IN A VAULT

BRIEF SUMMARY OF THE INVENTION

This invention relates to anti-theft systems, and more particularly to a system for providing an alarm in response to an attempt to steal the currency contained in a currency-containing vault, for example an automatic teller machine (ATM).

U.S. Pat. No. 4,975,680, issued Dec. 4, 1990, the entire disclosure of which is incorporated by reference, describes in detail a currency alarm pack designed for inclusion in the currency supply of an automatic teller machine. The alarm pack resembles real currency, but includes a pyrotechnic charge, which, when triggered by electronic circuitry within the pack, causes the release of dye, tear gas, or both.

The alarm pack of U.S. Pat. No. 4,975,680 includes a motion detector. Motion of the alarm pack (other than the ordinary motion associated with feeding of currency in the ATM) causes the circuitry within it to go into an "awake" state for a predetermined interval of time. If no further motion occurs, the circuitry reverts to its quiescent state. While in the "awake" state, the circuitry responds to a localized r.f. field generated by an alarm, which can be responsive to various conditions, including, but not necessarily limited to, opening of the access door of the ATM. Triggering of the alarm takes place after the alarm pack is removed from the proximity to the localized field.

To achieve a high degree of immunity to unintended triggering, the alarm pack requires motion to occur during a predetermined interval after the localized field ceases to be detected. This prevents unintended triggering which could occur, for example, if an authorized ATM service person enters the ATM through an access door to replenish the cash supply, moves the alarm pack, and then exits the ATM, shuts the door, and thereby cuts off the field before the alarm pack reverts to its quiescent state. Closing the access door would quench the field and arm the alarm pack, causing it to trigger after a predetermined time delay.

More specifically, the alarm pack in accordance with U.S. Pat. No. 4,975,680 includes a motion detector, a field detector, a timer for establishing a predetermined delay interval following the time at which the field detector ceases to detect the localized field, an alarm, and logic, responsive to the timer, the motion detector and the field detector, for triggering the alarm if, and only if (a) the field detector detects the localized field and thereafter ceases to detect the localized field, (b) the motion detector detects motion of the alarm pack during the predetermined delay interval, and (c) the field detector does not again detect the field during the predetermined delay interval.

One way for a thief to defeat the alarm pack scheme described in U.S. Pat. No. 4,975,680 is to steal the entire ATM rather than attempt to break into it. This has been known to happen on a number of occasions, and is especially likely to occur in the case of ATMs of relatively small size in isolated locations. The thief, equipped with the appropriate tools and a truck, can cart off the ATM, and dismantle it at leisure at a location of his own choice.

It is possible, of course, to provide a separate alarm system on the machine itself, with separate means for defacing the currency in the event of an attempt to move the machine. However, this is difficult to achieve, and not entirely satisfactory.

The principal object of this invention is to provide a simple, inexpensive and effective system for defeating attempts at theft by transportation of an entire ATM.

The invention addresses the problem of theft of the entire ATM by providing a control for the localized field, which activates the field momentarily when the machine is moved, and then prevents reactivation of the field by further movement of the machine during an interval exceeding the predetermined delay interval during which motion of the alarm pack will cause triggering. Thus, continued movement of the machine will cause triggering of the alarm pack.

More specifically, the anti-theft system in accordance with the invention comprises, in combination with a vault containing currency, such as an automatic teller machine, means for producing a localized field in response to motion of the vault. The field-producing means activates the localized field momentarily and thereafter deactivates the field and disables the field for a first predetermined interval. Triggerable currency alarm means in the currency within the vault includes field detection means and motion detection means. The currency alarm is triggered when the following three conditions concur. First, the field detection means detects the localized field and thereafter ceases to detect the localized field. Second, the motion detection means detects motion of the alarm means during a predetermined delay interval within the first predetermined interval through which the field is disabled. Third, the field detection means does not reacquire the localized field during the predetermined delay interval.

In the case of an ATM, an attempt to move the entire ATM will cause momentary activation of the localized field, followed by an interval during which the localized field is disabled. Further movement of the ATM within the interval during which the localized field is disabled will be detected by the motion detection means, thereby causing triggering of the currency alarm.

By generating a momentary field, and then disabling the field for an interval of time when movement of the ATM takes place, the field producing means causes the alarm pack to behave just as it would if it were being stolen from the machine. A significant advantage of the invention is that it does not require any changes in the alarm pack itself. The alarm pack can be as described in U.S. Pat. No. 4,975,680.

Further objects, details and advantages of the invention will be apparent from the following detailed description, when read in conjunction with the drawings.

DETAILED DESCRIPTION

Figure 1:
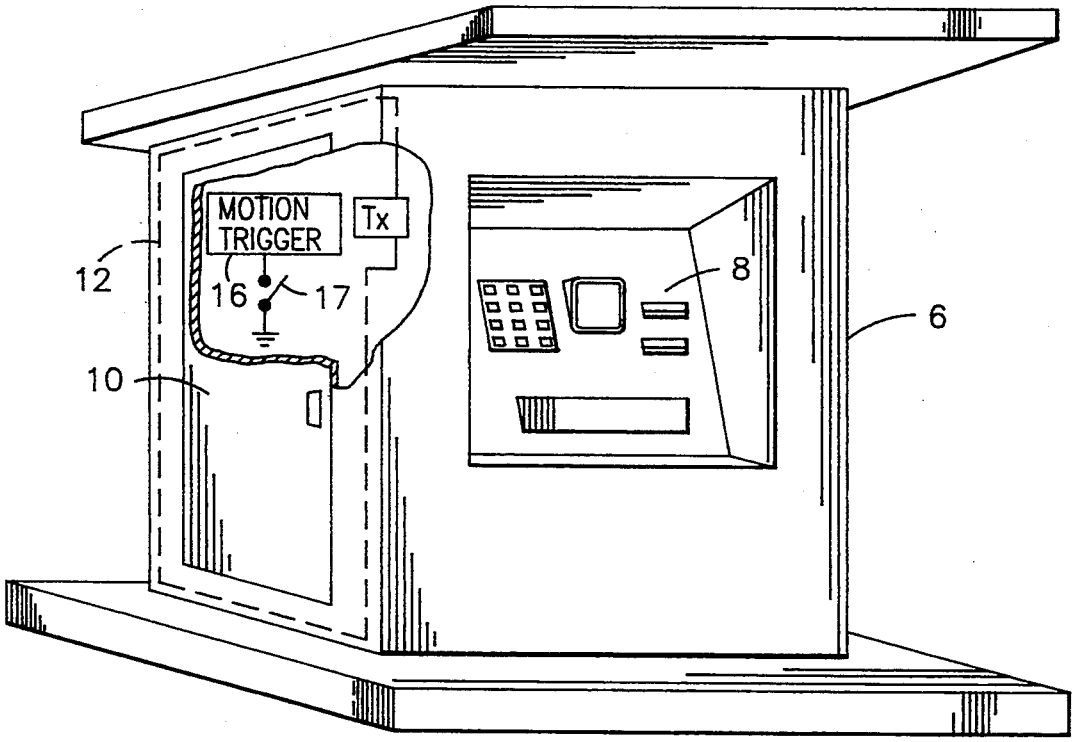
FIG. 1 is a partially broken-away perspective view of an automatic teller machine (ATM) enclosure, showing the access door and a localized field generating transmitter Tx, activated by an alarm and alternatively by motion of the automatic teller machine.

The enclosure 6 in FIG. 1 is a typical enclosure housing an ATM 8. The enclosure has an access door 10 through which service personnel can enter and leave the interior of the enclosure for the purpose of replenishing the cash supply, repairing the machine, or performing other service functions.

The access door 10 in FIG. 1 is surrounded by an electrically conductive loop 12, or other antenna system, which is energized by a transmitter Tx to provide a localized induction field, preferably having a frequency, an intensity, and possibly other characteristics, such that it is not easily duplicated, either intentionally by malefactors, or inadvertently by r.f. sources such as mobile radio transmitters.

The field is energized by a motion trigger 16, which provides power to transmitter Tx when an alarm signal is provided, and/or when motion of the ATM is detected. In the ATM shown in FIG. 1, the alarm system is represented by normally open switch 17. The alarm system, of course, can be relatively complex, responding to various conditions, for example opening of an access door, the breaking of an electrically conductive loop, or the activation of an infrared motion detector.

Figure 2:
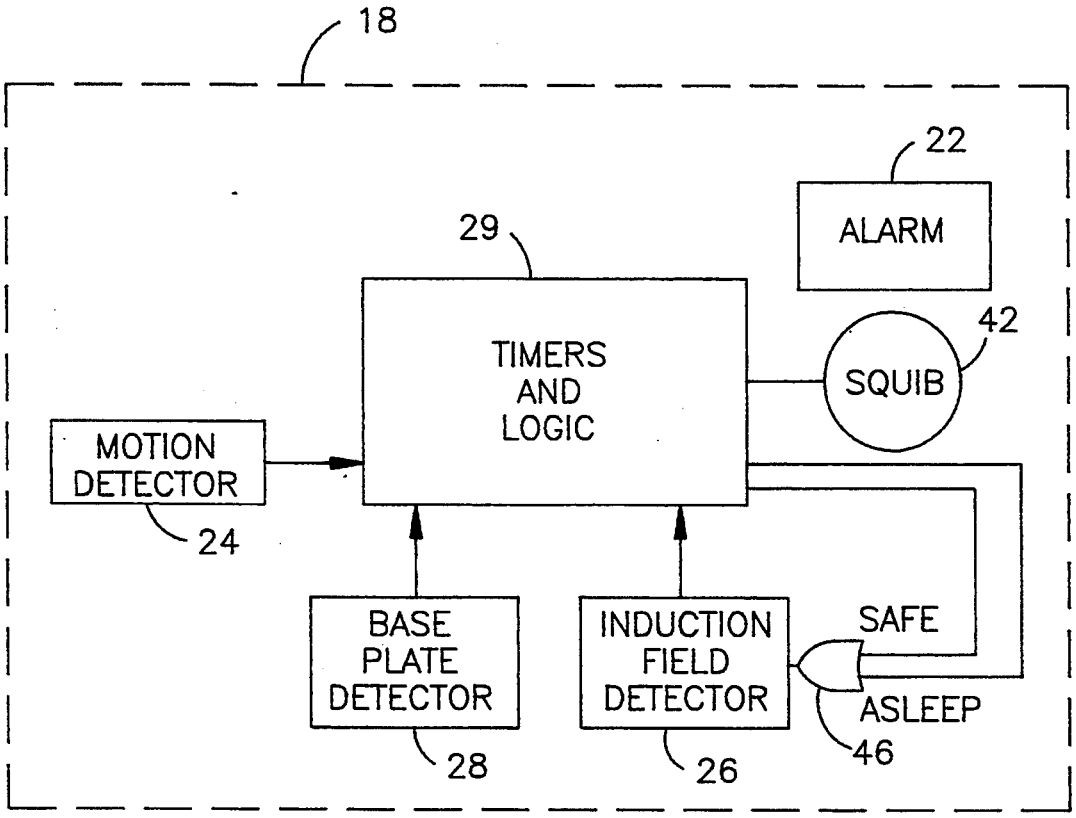
FIG. 2 is a simplified schematic diagram showing the elements of the firing circuit within a currency alarm pack in accordance with U.S. Pat. No. 4,975,680.

The currency alarm pack 18, in accordance with the U.S. Pat. No. 4,975,680, suitable for inclusion along with real currency in an ATM cassette, is shown in FIG. 2. It includes a squib-fired alarm device 22, such as a smoke generator for releasing colored smoke, which dyes the currency in a stolen cassette a distinctive color, making it essentially useless. The smoke is also released into the atmosphere making it possible to identify the person carrying the cassette easily. The coloring agent can be an ink, a dye or other material.

The electronic apparatus, as shown in FIG. 2 includes a motion detector 24, which may comprise one or more mercury switches designed to close a circuit when the alarm pack is moved. The mercury switches are oriented so that they are not activated by the ordinary advancing movement of the alarm pack which takes place as currency is being issued by the ATM. Typically, such movement is perpendicular to the planes of the banknotes in the currency supply. Movements of the alarm pack which would necessarily take place during a theft, i.e. movements having components in the planes of the banknotes, activate the switches.

The apparatus also includes an induction field detector 26, which is a receiver tuned to the frequency of the induction field, and designed to discriminate against extraneous fields such as radio and television signals, and the field produced by 50 or 60 Hz. current in electric power lines. Although frequency-selective tuning will ordinarily suffice, sophisticated discrimination techniques, including coded pulse modulation or frequency shift keying, can be used in the system transmitter and field detector.

An optional base plate detector 28, which responds to one or more magnets in a specially designed carrier, is also included in the alarm pack of FIG. 2 to insure safety of the alarm pack when it is being shipped or carried by authorized personnel.

The motion detector, field detector, and base plate detector are all connected to a timer and logic apparatus 29, which is described in detail in U.S. Pat. No. 4,975,680. The induction detector is enabled and disabled by the output of OR gate 46, which receives two inputs from the timer and logic apparatus 29. Briefly, the operation of the alarm pack of FIG. 2 is as follows.

When the alarm pack is properly situated in a carrier, the base plate detector maintains the timer and logic circuit 29 is in a "safe" condition.

Assuming that the alarm pack is out of its carrier, but is in place in a cassette in an ATM, the alarm pack will be in its "asleep" state.

If the alarm pack is moved, for example in the course of a theft, motion detector 24 will cause the alarm pack to go into its "awake" state, in which the induction field detector 26 is enabled. It will remain in the "awake" state for a predetermined time, and ultimately revert to its "asleep" state, unless further motion occurs.

If the alarm pack detects the induction field while in its "awake" state, it goes to a "ready" state. This could occur if the field is turned on while the alarm pack is in a position to detect the field, or if the alarm pack moves into an active field, or if the alarm pack is located into an active field when it goes into its "awake" state.

If, while in its "ready" state, the alarm pack is moved out of the field, so that the field is no longer sensed by detector 26 the alarm pack goes into its "armed" state. After a predetermined firing delay interval following loss of field by the field detector, squib 42 is fired, provided that the field is not reacquired, and further provided that motion occurs within the firing delay interval. In other words, in order for the squib to fire, the field must not be detected during the firing delay interval, and motion of the alarm pack must occur at some point during the firing delay interval.

If the alarm pack is in the "armed" state, and the field is reacquired before firing takes place, the alarm pack reverts to its "ready" state, and another loss of field and further motion of the alarm pack are required in order for firing to take place.

The requirement for motion during the firing interval prevents unintended firing of the squib when, following movement of the alarm pack during servicing of the ATM, the alarm pack detects and then loses the exit field as a result of opening and closing of the ATM access door.

Because the alarm pack operates in accordance with the above-described sequence, it is highly resistant to countermeasures, and to accidental triggering.

The present invention causes firing of the alarm pack to take place when an attempt is made to transport the entire ATM containing the alarm pack. In order to accomplish this objective, the induction field transmitter Tx is controlled by motion trigger 16 in such a way that motion of the entire ATM by thieves causes the alarm pack to progress from its "asleep" state through its "armed" state, and to fire, while in place in the ATM currency cassette, thereby rendering the currency in the ATM's currency supply useless to the thieves.

Figure 3:
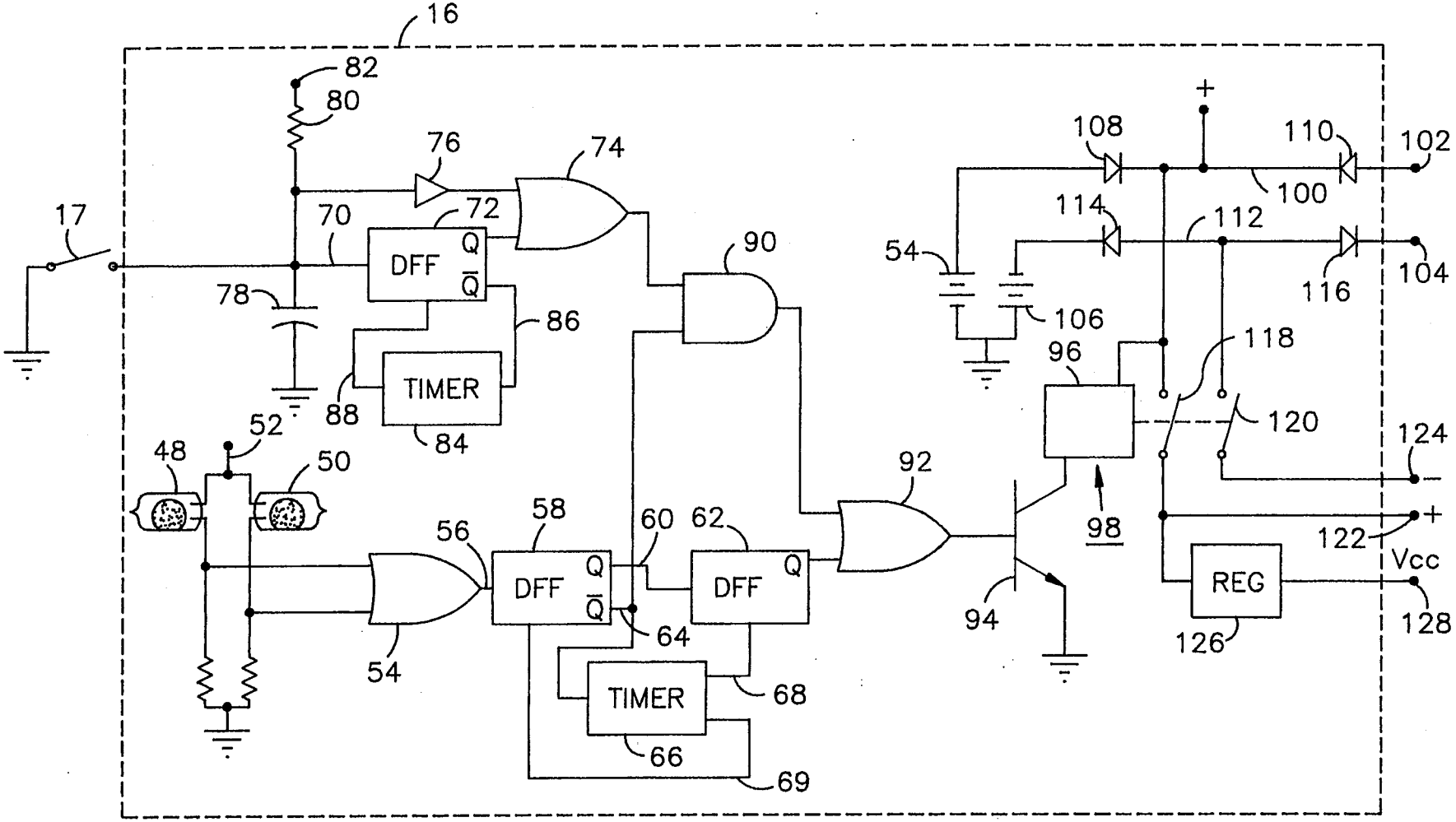
FIG. 3 is a schematic diagram showing details of the motion-trigger of FIG. 1.

As shown in FIG. 3, motion trigger 16 comprises a pair of mercury switches 48 and 50, which are arranged to detect various motions of the ATM 8. When the ATM is moved, at least one of these two switches closes momentarily, connecting the positive supply at terminal 52, to an input of OR gate 54. The output of OR gate 54 in line 56 triggers a clock input of "D" flip flop (DFF) 58, causing the Q output in line 60 to trigger the clock input of a similar "D" flip flop 62, and thereby simultaneously setting flip flop 62. When the complementary output of flip flop 58, at line 64, goes high, timer 66 is initiated, and, after a first preestablished time interval, provides a signal in line 68, which resets flip flop 62. After a further preestablished time interval timer 66 provides a signal in line 69 which resets flip flop 58. When timer 58 is reset, its complementary Q output goes high and resets timer 66.

Timer 66 preferably comprises a counter and an oscillator which delivers a series of pulses to the counter. The resetting signal for flip flop 62 occurs at a first predetermined count, and the resetting signal for flip flop 58 occurs at a second predetermined count. In a typical circuit, flip flop 62 is set for an interval of ten seconds, while flip flop 58 is set for two minutes. Until flip flop 58 is reset, it is not possible for flip flop 62 to be retriggered. Therefore, after the Q output of flip flop 62 goes high and returns to its low condition, there is an interval, typically one minute and fifty seconds, in which the output of flip flop 62 cannot go high.

Normally open switch 17, which represents the alarm system of the ATM, is connected, by line 70, to the clock input of another "D" flip flop 72, the Q output of which is connected to one of the two inputs of OR gate 74. Line 70 is also connected to the input of inverter 76, the output of which is connected to the other input of OR gate 74. Line 70 is connected through capacitor 78 to ground, and through resistor 80 to a positive supply terminal 82. DFF 72 is provided with a timer 84, similar to timer 66, which is connected, through line 86, to the complementary output of DFF 72 so that it is initiated when the Q output goes high. After a predetermined interval, the timer delivers a resetting signal to DFF 72 through line 88.

The output of OR gate 74 is connected to one of the inputs of two-input AND gate 90. The other input of AND gate 90 is connected to the complementary Q output of DFF 58 in line 64.

The output of AND gate 90 is connected to one input of OR gate 92, the other input of which is taken from the Q output of DFF 62. The output of OR gate 92 drives the base of transistor 94, the collector-emitter circuit of which is connected in series with coil 96 of relay 98, between a positive DC supply at line 100 and ground.

Terminals 102 and 104 are provided for connection respectively to positive and negative DC supply voltages derived from the AC current supplied to the ATM through a power supply circuit (not shown). Batteries 54 and 106 provide emergency power in case of failure of the AC current. Battery 54 and supply terminal 102 are connected to positive line 100 respectively through diodes 108 and 110. Battery 106 and supply terminal 104 are connected to negative supply line 112 through diodes 114 and 116 respectively.

Figure 4:
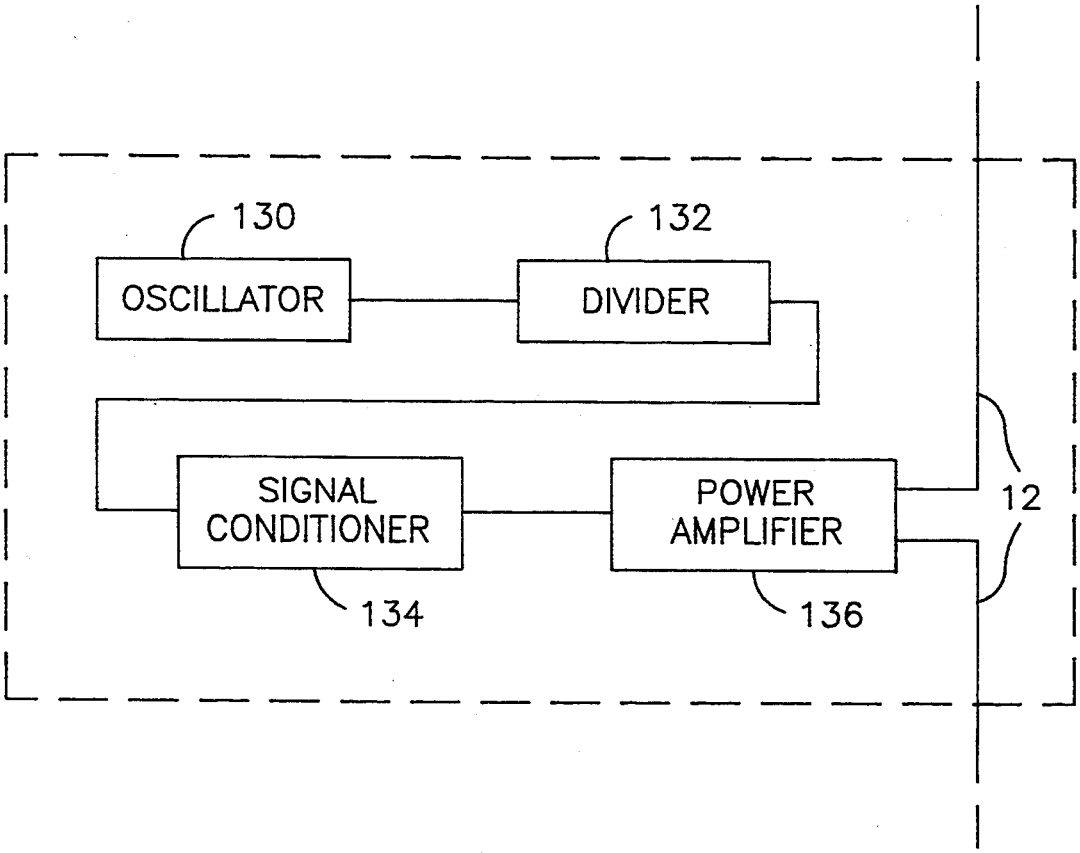
FIG. 4 is a schematic diagram showing the principal elements of the field generating transmitter Tx of FIG. 1.

When relay 98 is activated, its contacts 118 and 120 connect positive supply line 100 to terminal 122 and negative supply line to terminal 124. In addition, contacts 118 connect positive supply line 100 to a regulator 126, which supplies a voltage $V_{cc}$ to terminal 128. The voltages at terminals 122, 124 and 128 operate the transmitter, which, as shown in FIG. 4, comprises an oscillator, 130, a frequency divider 132, a signal conditioner 134 and a power amplifier 136, the latter having its output connected to loop 12. When relay 98 (FIG. 3) is activated so that its contacts 118 and 120 are closed, the transmitter and loop 12 produce a field which can be sensed by the alarm pack.

In the operation of the circuit of FIG. 3, activation of the ATM alarm, for example by opening of the access door, causes contacts 17 to close. This grounds the input to inverter 76 and causes a high condition at the output of the inverter. The output of OR gate 74 goes high, and since the complementary Q output of DFF 58 is high, the output of AND gate 90 goes high. The output of OR gate 92 likewise goes high and effects closure of the contacts of relay 98 to operate the transmitter. When contacts 17 open, a positive-going pulse appears in line 70 at the clock input of DFF 72. This triggers the DFF so that its Q output goes high and remains high for an interval determined by timer 84. This interval might be 30 minutes, for example. At the end of the interval determined by timer 34, DFF 72 is reset and the transmitter is turned off.

If motion of the ATM is detected by either of mercury switches 48 and 50, a positive voltage appears at one or both of the inputs of OR gate 54, causing the output of the OR gate to go high and trigger DFF 58. DFF 62 is simultaneously triggered by the Q output of DFF 58. When the Q output of DFF 62 goes high, the output of OR gate 82 goes high, causing relay 98 to operate the transmitter. Flip flop 62 remains set for an interval determined by timer 66, typically ten seconds. Flip flop 58 remains set for a longer interval, typically two minutes, and as mentioned previously, it is not possible for flip flop 62 to be triggered during while flip flop 58 remains set. While flip flop 58 is set, the complementary Q output in line 64 remains low, thereby disabling AND gate 90. Consequently, during a predetermined interval, typically one minute and fifty seconds, following resetting of flip flop 62, the transmitter is disabled. This interval should be longer than the firing delay interval of the alarm pack, i.e. the interval following the onset of the "armed" state after which firing occurs.

Figure 5:
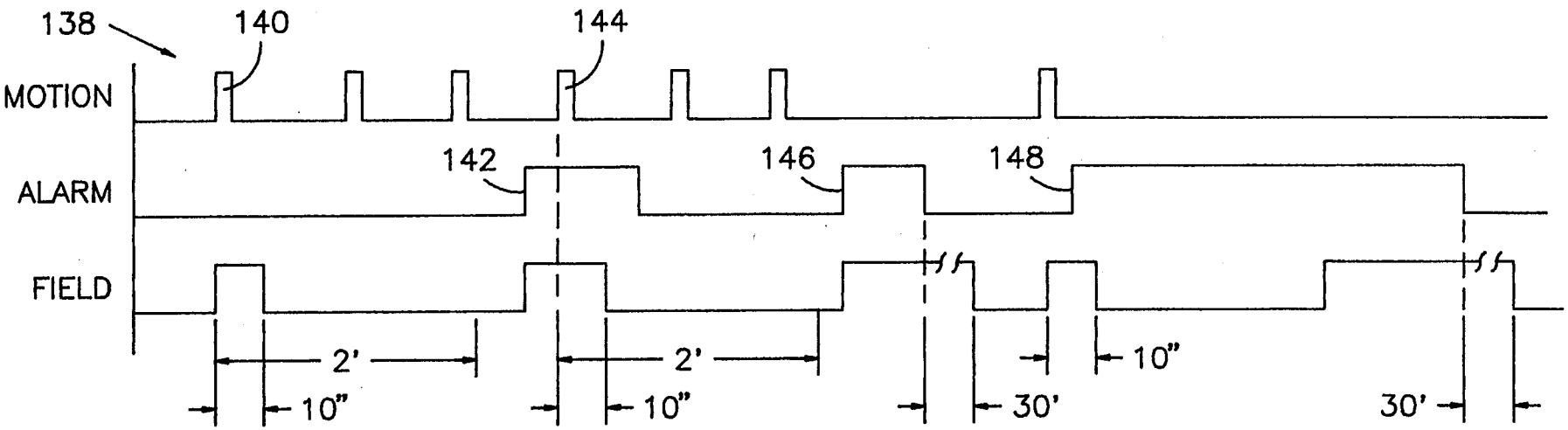
FIG. 5 is a time diagram, illustrating the operation of the circuitry of FIG. 2.

The diagram of FIG. 5 illustrates how the field is activated by motion of the ATM and by the ATM alarm. ATM motions are represented, in somewhat idealized form, by pulses 138, which represent the output of OR gate 54 at line 56 (FIG. 3). The second line represents the condition of the ATM alarm switch 17. The third line represents the induction field. The time intervals indicated are exemplary only.

A first motion of the ATM produces a pulse 140, which causes the field to be activated for a ten second interval, following which the field is inhibited for one minute and fifty seconds.

If, after the expiration of the one minute and fifty seconds, the alarm is activated, as indicated by pulse 142, the field is again activated. However, while the alarm is on, the ATM is moved causing a pulse 144 to be produced. This pulse triggers flip flops 58 and 62. Setting of flip flop 58 disables AND gate 90. Therefore, when timer 66 resets flip flop 62 after ten seconds, the field is turned off, despite the active condition of the ATM alarm. The field is again disabled for one minute and fifty seconds, until timer 66 resets flip flop 58.

If the ATM alarm is activated, as indicated by pulse 146, and no motion of the ATM occurs, the field will be activated, and will remain activated for thirty minutes after the alarm pulse ends. Although not illustrated, if the ATM is moved after the alarm pulse ends, but during the thirty minute interval following cessation of the alarm pulse, the field will be deactivated ten seconds following the detection of motion, and will remain deactivated for at least one minute and fifty seconds.

If an alarm pulse at 148 begins after the field is activated by ATM motion, it will not prevent the field from being inhibited for the one minute and fifty second interval. Regardless of whether or not alarm pulse 148 begins while the field is active, if the alarm pulse begins before the expiration of a one minute and fifty second interval during which the field is inhibited and is sustained until after the inhibition interval expires, the field will remain activated for thirty minutes after the alarm pulse ceases, unless inhibited as a result of ATM motion.

In the event that a thief breaks into an ATM and attempts to steal the currency supply cassette, the ATM alarm will activate the induction field. The field will remain active while the alarm is activated, and for thirty minutes after the alarm is deactivated. When the cassette, containing the alarm pack, is moved out of the field, the conditions required for firing of the alarm pack are present: loss of field, and motion of the alarm pack. The squib contained in the alarm pack will be fired after a short predetermined delay, and will cause release of dye, and other consequences depending on the nature of the alarm device contained in the alarm pack.

In the case of an attempt to move the entire ATM, the activation, and immediate deactivation, of the induction field by the motion triggered transmitter will cause the alarm pack to behave as if it were being removed from the ATM. Again the conditions required for firing, loss of field and motion of the alarm pack, are present. Here again, the squib in the alarm pack will be fired after a short delay. The firing delay interval in the alarm pack and the interval during which the field is disabled by the field control circuitry which is part of the ATM are independently determined. However, in the case of motion of the ATM, these two intervals begin at the same instant. Since the interval through which the field is disabled is longer than the firing delay interval, it is possible for motion of the alarm pack, occurring as a result of motion of the entire ATM, to cause firing of the squib in the alarm pack.

The motion triggered transmitter described herein provides a very effective way to defeat attempts by thieves to steal the money supply of an ATM by carting off the entire ATM. The motion triggered transmitter accomplishes this result in a very simple manner by causing the alarm pack to deface the ATM money supply while it is still in the ATM.

Various modifications can be made to the apparatus described herein. For example, circuits utilizing monostable multivibrators instead of flip flops and pulse-counting timers, can be used to effect activation of the induction field and inhibition thereof for the required interval. Other forms of motion detectors can be used, and other schemes for activating and deactivating the field-generating transmitter can be used. While the anti-theft system of the invention has been described with reference to its use in in an ATM, the system can be used in other forms of vaults, for example currency storage vaults in retail stores. Many other modifications will occur to persons skilled in the art and can be made without departing from the scope of the invention as defined in the following claims.

I claim:

1. In combination with a vault containing currency, an anti-theft system comprising:

means for producing a localized field in response to motion of the vault, said field-producing means activating said field momentarily and thereafter deactivating said field and disabling said field for a first predetermined interval; and currency alarm means in the currency within said vault, for producing an alarm, said currency alarm means including field detection means and motion detection means, and producing the alarm on the condition that:

a. the field detection means detects the localized field and thereafter ceases to detect the localized field, b. the motion detection means detects motion of the alarm means during a predetermined delay interval within said first predetermined interval, and c. the field detection means does not reacquire the localized field during said predetermined delay interval.

2. A vault for containing currency having:

(a) means for providing a localized field;

(b) central alarm means for activating the localized field providing means when said central alarm means is triggered in response to unauthorized opening of the vault;

(c) motion detection means providing a signal in response to movement of the vault; and (d) means, responsive to said signal, for first activating, and thereafter disabling, said localized field providing means, even when said central alarm means is not triggered, said signal-responsive activating and disabling means including means for establishing a first predetermined interval, activating said localized field providing means momentarily, and thereafter disabling said localized field providing means for said first predetermined interval;

whereby movement of the vault will cause momentary activation of said localized field providing means, followed by said predetermined interval, during which the localized field providing means is disabled, and said vault further including second alarm means, responsive to said localized field, said second alarm means comprising: additional motion detection means; field detection means; timing means for establishing a predetermined delay interval following the time at which the field detection means ceases to detect the localized field; means for providing an alarm; and logic means, responsive to the timing means, the additional motion detection means and the field detection means, for causing the alarm-providing means to provide an alarm if, and only if a. the field detection means detects the localized field and thereafter ceases to detect the localized field, b. the additional motion detection means detects motion of the alarm means during said predetermined delay interval, and c. the field detection means does not reacquire the localized field during said predetermined delay interval; and wherein said predetermined delay interval is shorter than the first predetermined interval for which the localized field providing means is disabled by said activating means.

3. A vault according to claim 2 including means, responsive to the signal provided by said motion detection means, for preventing said central alarm means from causing the localized field providing means to be activated during said first predetermined interval.

4. A vault according to claim 2 in which said means for activating and disabling said localized field providing means disables said localized field providing means for said first predetermined interval, following momentary activation thereof in response to said signal, regardless of whether or not said central alarm means has been triggered.

5. A vault for containing currency having:

(a) means for providing a localized field;

(b) central alarm means for activating the localized field providing means when said central alarm means is triggered in response to unauthorized opening of the vault;

(c) motion detection means providing a signal in response to movement of the vault; and (d) means, responsive to said signal, for first activating, and thereafter disabling, said localized field providing means, even when said central alarm means is not triggered, said signal-responsive activating and disabling means including means for establishing a predetermined interval, activating said localized field providing means momentarily, and thereafter disabling said localized field providing means for said predetermined interval;

whereby movement of the vault will cause momentary activation of said localized field providing means, followed by said predetermined interval, during which the localized field providing means is disabled, and wherein said signal responsive means for activating and disabling said localized field providing means comprises first and second flip flops, means for setting each of the first and second flip flops to a set state in response to said signal, timer means for resetting said second flip flop following a first interval of time after setting thereof, and for resetting said first flip flop following a second interval of time after setting thereof, said second interval being greater than said first interval, and means for preventing said second flip flop from being set following resetting thereof until after said first flip flop is reset.

6. A vault according to claim 5 in which said means for providing a localized field is responsive to the state of said second flip flop.

7. A vault according to claim 5 in which said timer means comprises oscillator means for producing a series of pulses and counter means for counting said pulses, and in which said first and second flip flops are connected to be reset in response to different counts in said counter means.

8. A vault for containing currency having:

(a) means for providing a localized field;

(b) central alarm means for activating the localized field providing means when said central alarm means is triggered in response to unauthorized opening of the vault;

(c) motion detection means providing a signal in response to movement of the vault; and (d) means, responsive to said signal, for first activating, and thereafter disabling, said localized field providing means, even when said central alarm means is not triggered, said signal-responsive activating and disabling means including means for establishing a predetermined interval, activating said localized field providing means momentarily, and thereafter disabling said localized field providing means for said predetermined interval;

whereby movement of the vault will cause momentary activation of said localized field providing means, followed by said predetermined interval, during which the localized field providing means is disabled, and wherein said signal responsive means for activating and disabling said localized field providing means comprises a first flip flop, means receiving, and responsive to, said signal for setting said first flip flop to a set state, said first flip flop providing an output signal, a second flip flop, and means receiving, and responsive to, said output signal from said first flip flop for setting said second flip flop to a set state, timer means, responsive to the condition of said first flip flop, for resetting said second flip flop following a first interval of time after setting thereof, and for resetting said first flip flop following a second interval of time after setting thereof, said second interval being greater than said first interval.

9. A vault according to claim 8 in which said means for providing a localized field is responsive to the state of said second flip flop.

10. A vault according to claim 8 in which said timer means comprises oscillator means for producing a series of pulses and counter means for counting said pulses, and in which said first and second flip flops are connected to be reset in response to different counts in said counter means.

11. A vault for containing currency having:

(a) means for providing a localized field;

(b) central alarm means for activating the localized field providing means when said central alarm means is triggered in response to unauthorized opening of the vault;

(c) motion detection means providing a signal in response to movement of the vault; and (d) means, responsive to said signal, for first activating, and thereafter disabling, said localized field providing means, even when said central alarm means is not triggered, said signal-responsive activating and disabling means including means for establishing a predetermined interval, activating said localized field providing means momentarily, and thereafter disabling said localized field providing means for said predetermined interval;

whereby movement of the vault will cause momentary activation of said localized field providing means, followed by said predetermined interval, during which the localized field providing means is disabled, and wherein a currency supply is located within the vault and currency alarm means is incorporated into said currency supply so that when the currency supply moves the currency alarm means undergoes corresponding movement, said currency alarm means providing an alarm in response to unauthorized movement of at least a part of said currency supply through said localized field, said currency alarm means comprising: additional motion detection means; field detection means; timing means for establishing a predetermined delay interval following the time at which the field detection means ceases to detect the localized field; means for providing an alarm; and logic means, responsive to the timing means, the additional motion detection means and the field detection means, for causing the alarm-providing means to provide an alarm if, and only if a. the field detection means detects the localized field and thereafter ceases to detect the localized field, b. the additional motion detection means detects motion of the alarm means during said predetermined delay interval, and c. the field detection means does not reacquire the localized field during said predetermined delay interval; and wherein said predetermined delay interval is shorter than the predetermined interval for which the localized field providing means is disabled by said activating means.

12. In an automatic teller machine comprising a housing, a cash delivery mechanism within said housing, and a cash supply within said housing, an anti-theft system comprising:

(a) means for providing a localized field;

(b) central alarm means for activating the localized field providing means when said central alarm means is triggered in response to unauthorized attempts to tamper with the machine;

(c) currency alarm means incorporated into said cash supply so that when the cash supply moves the currency alarm means undergoes corresponding movement, said currency alarm means providing an alarm in response to unauthorized movement of at least a part of said cash supply through said localized field, said currency alarm means comprising: first motion detection means; field detection means; timing means for establishing a predetermined delay interval following the time at which the field detection means ceases to detect the localized field; means for providing an alarm; and logic means, responsive to the timing means, the first motion detection means and the field detection means, for causing the alarm providing means to provide an alarm if, and only if i. the field detection means detects the localized field and thereafter ceases to detect the localized field, ii. the motion detection means detects motion of the alarm means during said predetermined delay interval, and iii. the field detection means does not reacquire the localized field during said predetermined delay interval;

the improvement comprising:

(d) additional motion detection means providing a signal in response to movement of said housing; and (e) additional means, responsive to said signal, for activating said localized field providing means, even when said central alarm means is not triggered, said additional means activating said localized field providing means momentarily and thereafter disabling said localized field providing means for an interval exceeding said predetermined delay interval;

whereby a movement of the entire housing will cause momentary activation of said localized field providing means, followed by an interval during which the localized field providing means is disabled, and further movement of said housing within said interval during which the localized field providing means is disabled will be detected by said first motion detection means, thereby causing activation of the currency alarm means by operation of the alarm providing means.

* * * * *